United States Patent [19]

Kurushima et al.

[11] Patent Number: 4,505,101

[45] Date of Patent: Mar. 19, 1985

[54] APPARATUS FOR REMOVING TRASH IN AN OPEN-END SPINNING FRAME

[75] Inventors: Tadanori Kurushima, Kariya; Hideo Hidaka, Aichi; Hiroyoshi Sonoda, Kariya, all of Japan

[73] Assignee: Kabushiki Kaisha Toyoda Jidoshokki Seisakusho, Kariya, Japan

[21] Appl. No.: 560,451

[22] Filed: Dec. 12, 1983

[30] Foreign Application Priority Data

Dec. 17, 1982 [JP] Japan ..... 57-222424

[51] Int. Cl.[3] ..... D01H 7/888

[52] U.S. Cl. ..... 57/301; 15/301; 15/312 R; 15/419; 57/304; 57/411

[58] Field of Search ..... 57/301, 302, 304, 305, 57/408, 411; 15/301, 306 R, 312 R, 419

[56] References Cited

U.S. PATENT DOCUMENTS 4,009,562 3/1977 Stalder ..... 57/301
4,142,356 3/1979 Husges et al. ..... 57/301
4,162,556 7/1979 van Ditschuizen et al. ..... 15/312 R
4,204,393 5/1980 Miyazaki et al. ..... 57/304 X
4,249,370 2/1981 Vecera et al. ..... 57/301
4,314,440 2/1982 Onoue et al. ..... 57/304 X

*Primary Examiner*—John Petrakes

[57] ABSTRACT

An apparatus for removing trash in an open-end spinning frame is disclosed herein. According to the invention, an open-end spinning unit is provided with a trash transporting chamber which is communicated with an opening which is formed on part of the inner peripheral surface of a space in which a combing roller is rotatably disposed and through which part of the circumferential surface of the rotating combing roller is exposed. The trash transporting chamber is so constructed that its interior is placed substantially under an atmospheric pressure, and a side wall thereof facing opposedly toward the opening is spaced from the circumferential surface of the combing roller exposed through said opening at a distance falling within a range from a dimension which is substantially equal to the diameter of the combing roller to a dimension which is about two times said diameter.

4 Claims, 5 Drawing Figures

APPARATUS FOR REMOVING TRASH IN AN OPEN-END SPINNING FRAME

BACKGROUND OF THE INVENTION

The present invention relates generally to an apparatus for removing trash or foreign matters contained in fibers in a spinning unit of an open-end spinning frame. More specifically, it relates to an apparatus for removing and transporting the trash with an improved efficiency without allowing the trash to be drawn back into the fibers and carried into a spinning rotor in the open-end spinning unit.

In a conventional open-end spinning unit as exemplified in FIG. 1 and designated generally by reference numeral 1, a sliver 3 introduced through a sliver inlet 2 is advanced by a feed roller 4 rotating in a direction to feed the sliver and a presser 5 operable in conjunction therewith to a cylindrical combing roller 6 which is rotatably disposed within a space formed in the spinning unit 1. The sliver 3 thus fed is opened or separated into individual fibers by the combing action of the rotating combing roller 6. The separated fibers are then transferred, while being combed by the combing roller 6, in the direction as depicted by an arrow along the circumferential surface of the combing roller 6 and introduced into a spinning rotor 11 through a fiber feed channel 10 under the influence of a current of air stream developed by vacuum which is created by rotation at an extremely high speed of the spinning rotor 11. The fibers are thereafter deposited in a fiber collecting groove formed at the outermost periphery in an annular form in the spinning rotor 11, and subsequently withdrawn as a strand of twisted spun yarn in a known way through a yarn channel (not shown) then to be taken up on a bobbin for forming a yarn package.

The inner peripheral wall of the space in which the combing roller 6 is rotatably disposed has an opening 8 through which part of the circumferential surface of the rotating combing roller 6 may be exposed to a trash discharging chamber 9 formed adjacently to the combing roller 6 in the spinning unit 1. Trash or foreign matters 7 contained in the sliver 3, including leaf pieces, neps, short fibers and other impurities, are removed from the fibers separated by the combing roller 6 and discharged through this opening 8 into the trash discharging chamber 9.

The trash discharging chamber 9 has at one end thereof an air inlet **9*a* and at the other opposite end thereof an exit 9*b* connected to an end of a trash pipe 12 through which the trash 7 is delivered from the chamber 9. The trash pipe 12 is connected at the other end thereof to a trash transporting duct 13 which is shared in common by a plurality of other similar trash pipes coming out from other spinning units of an open-end spinning frame, and which is connected to a trash collecting chamber 15 via a blower 14. In order to develop strong vacuum in the trash discharging chamber 9 for aiding in removal and delivery of the impurities 7, the air inlet 9*a* of the trash discharging chamber 9 is formed by an opening with such a small diameter that the chamber 9 is of a substantially closed construction. The impurities 7 removed from the fibers and discharged through the opening 8 into the trash discharging chamber 9 is drawn into the trash pipe 12 under the influence of a flow of air current caused by vacuum which is created by the blower 14 and then transported through the duct 13 up to the trash collecting chamber 15**, where the impurities thus transported are collected and stored with impurities delivered from other spinning units.

In the trash removing apparatus of the foregoing structure in an open-end spinning frame, wherein its trash discharging chamber 9 has a limited capacity and its air inlet hole **9*a* is of nearly closed configuration, the trash 7 is placed under the influence not only of the suction by the blower 14, but also of the suction effect caused by rotation of the spinning rotor 11**, with the result that various inconveniences or drawbacks are invited.

As described in the above, the trash 7 removed from the fibers and discharged into the trash discharging chamber 9 is carried therefrom into the trash pipe 12 by a current of air stream developed in the chamber. Since it is desirable that a relatively strong suction should be developed in the trash discharging chamber 9 for delivery of the refuses 7, the opening of the air inlet **9*a* of the trash discharging chamber 9 is restricted. Therefore, the trash discharging chamber 9 is susceptible to the influence of a suction due to the vacuum created by the high-speed rotation of the spinning rotor 11; i.e., the vacuum developed in the trash discharging chamber 9 aids the vacuum created due to the rotation of the spinning rotor 11 in exerting its suction effect on the trash discharging chamber 9. The result is that part of the trash once removed from the fibers and discharged through the opening 8 may be caught by such suction and drawn with the fibers into the spinning rotor 11 thereby to be deposited in the rotor and therefore included in the resulting spun yarn. Furthermore, because the capacity or space of the trash discharging chamber 9 is relatively small, there is a tendency of the impurities 7 discharged through the opening 8 impinging against any of the inner walls defining the trash discharging chamber 9 and then being rebounded, so that part of the impurities 7 thus rebounded from the wall may be caught and entrained by a flow of air stream caused by the abovesaid suction effect due to the rotation of the spinning rotor 11, and therefore introduced into the rotor together with fibers. In addition, formation of a so-called air curtain adjacently to the opening 8 due to strong air streams within the trash discharging chamber 9 makes it further difficult for the impurities 7 to be removed efficiently, but allowing part of them to be placed under the influence of the suction which acts in a direction opposite to discharging of the trash 7**.

One solution to avoid such phenomena would be to increase the velocity of the air flow by the blower 14 in the trash discharging chamber 9. However, such air flow would peel out not only the foreign matters 7 but also usable long fibers off the surface of the combing roller 6 and draw them toward the trash pipe 12, thus resulting in a decrease of yarn yield. Furthermore, an increase in the velocity of the air flow may cause the air outlet **9*b* of the trash discharging chamber 9 to be clogged with the trash 7 and fibers, thereby blocking the passage of the trash pipe 12**.

SUMMARY OF THE INVENTION

It is an object of the present invention, therefore, to remove the drawbacks and disadvantages of the prior art apparatus of the foregoing construction.

It is another object of the invention to provide an apparatus for removing trash in an open-end spinning frame the use of which can permit the trash removed from fibers to be discharged and transported with much more efficiency than heretofore.

According to the invention, an open-end spinning unit is provided with a trash transporting chamber which is directly communicated with an opening which is formed on part of the inner peripheral surface of a space in which a combing roller is rotatably disposed and through which part of the circumferential surface of the rotating combing roller is exposed. The trash transporting chamber is so constructed that its interior is placed substantially under an atmospheric pressure, and a side wall thereof facing opposedly toward the opening is spaced from the circumferential surface of the combing roller exposed through said opening with a distance falling within a range from a dimension which is substantially equal to the diameter of the combing roller to a dimension which is about two times said diameter.

Because the trash transporting chamber is so constructed that no vacuum is produced which is strong enough to induce an influential flow of air stream caused by the rotation of a spinning rotor and acting so strongly as to draw the impurities once removed from the fibers back toward the opening, the foreign matters discharged through the opening can be carried by a transporting flow of air stream with a greatly improved efficiency. Increasing the volume of space into which impurities are discharged in an open-end spinning unit can reduce the possibility of such impurities impinging against an interior wall to be rebounded thereby and caught by a stream of air due to the vacuum in the spinning rotor.

The above and other objects, features and advantages of the present invention will become more readily apparent from the following description of a preferred embodiment when taken in conjunction with the accompanying drawings in which a preferred embodiment of the invention is shown by way of an illustrative example.

DETAILED DESCRIPTION OF PREFERRED EMBODIMENT

Figure 1:
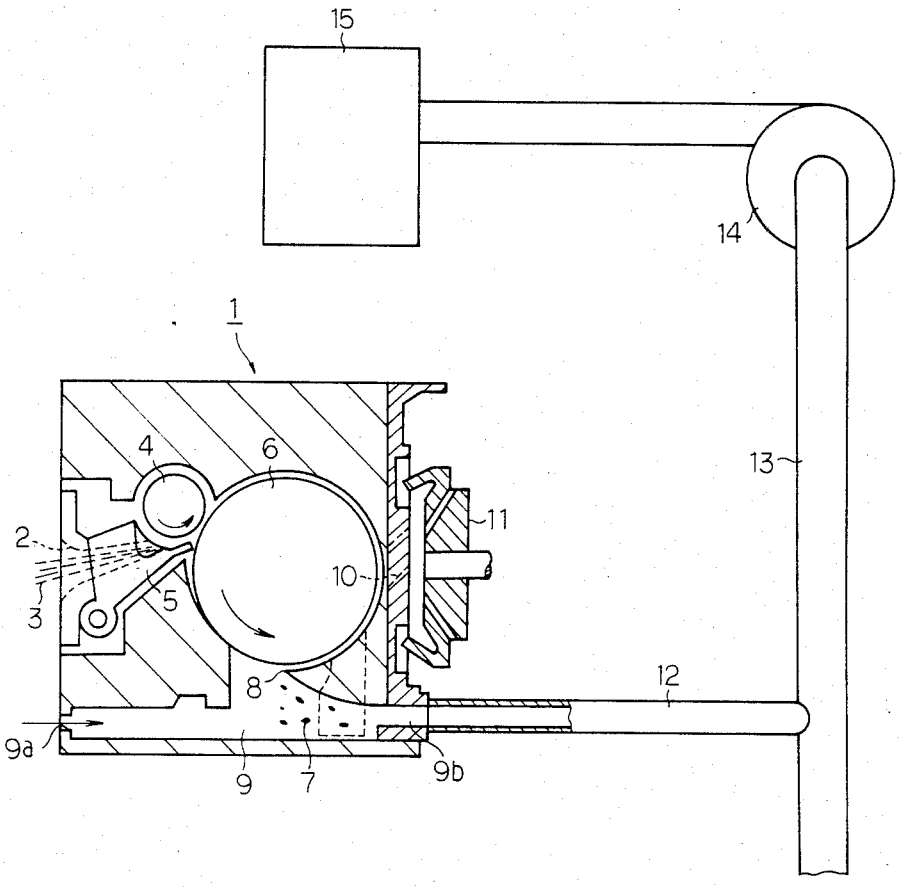
FIG. 1 PRIOR ART
FIG. 1 is a cross-sectional plan view of a conventional apparatus for removing trash in a spinning unit of an open-end spinning frame.

A preferred embodiment of trash removing apparatus in an open-end spinning frame according to the present invention will be now explained with reference to FIGS. 2 to 5. Since those parts in the apparatus which are shown in FIGS. 2 to 5 and have similar reference numerals to the counterparts already explained with reference to FIG. 1 exemplifying a conventional apparatus are constructed and operates substantially in the same way, detailed description thereof shall be omitted.

Figure 2:
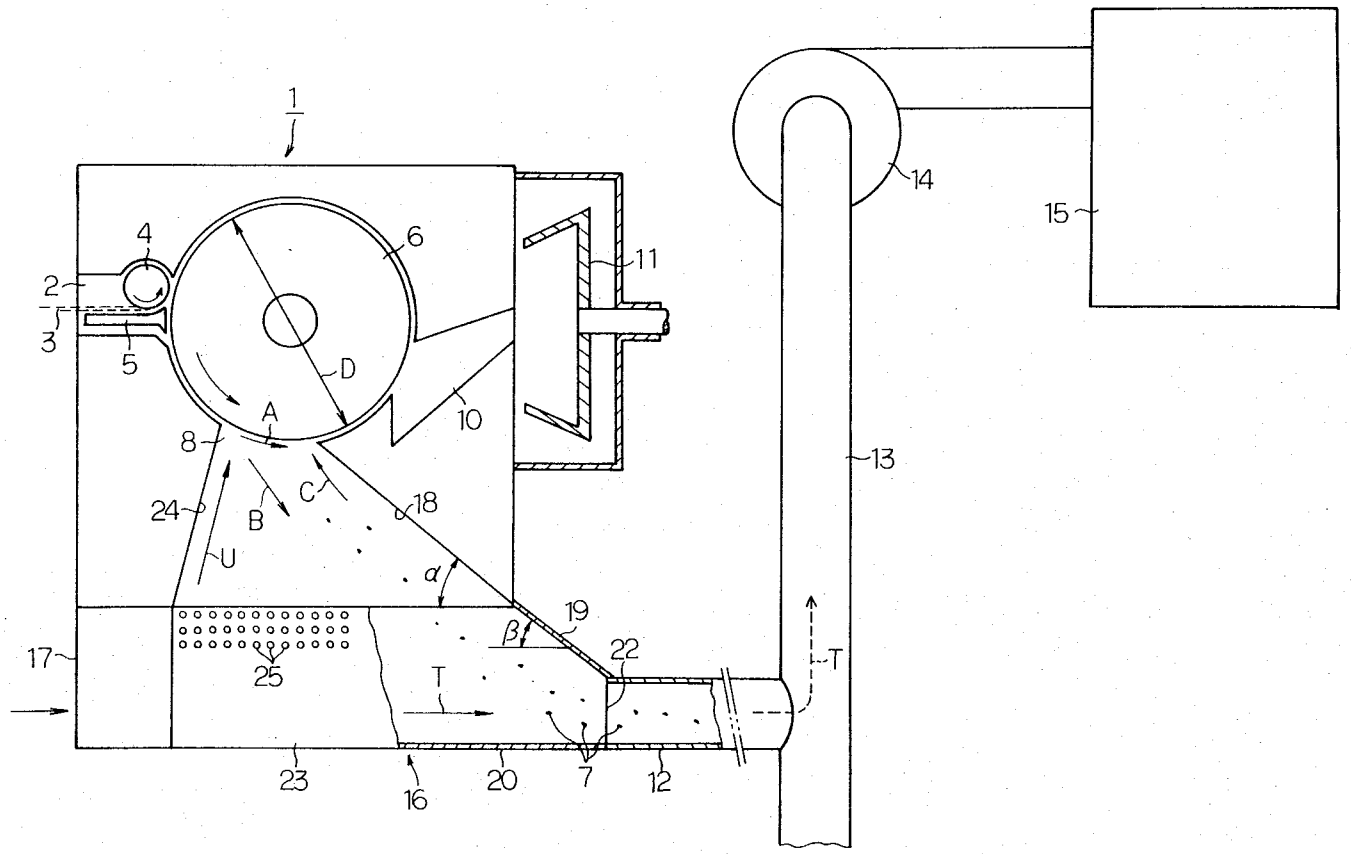
FIG. 2 is a cross-sectional plan view of an embodiment of trash removing apparatus of the invention in a spinning unit of an open-end spinning frame.
Figure 3:
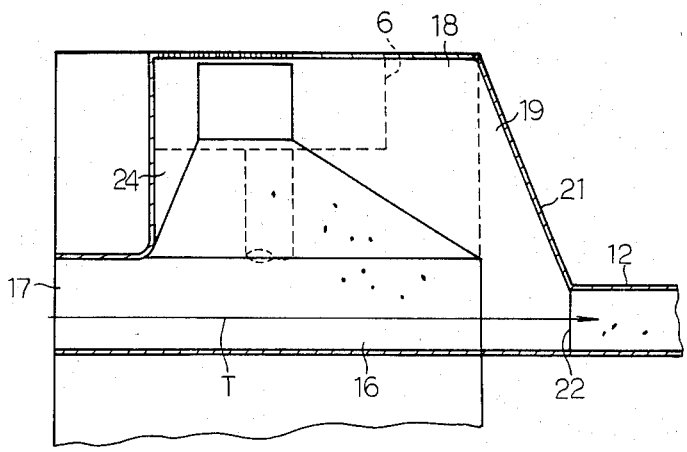
FIG. 3 is a cross-sectional front view of the apparatus of FIG. 2, showing a part thereof.
Figure 4:
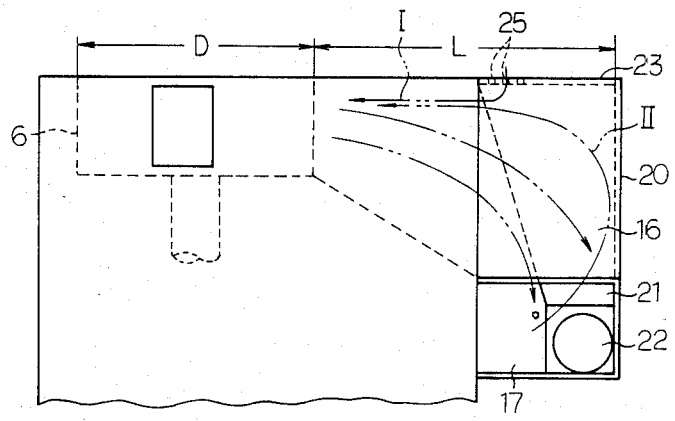
FIG. 4 is a cross sectional side view of the apparatus of FIG. 2, showing a part thereof.
Figure 5:
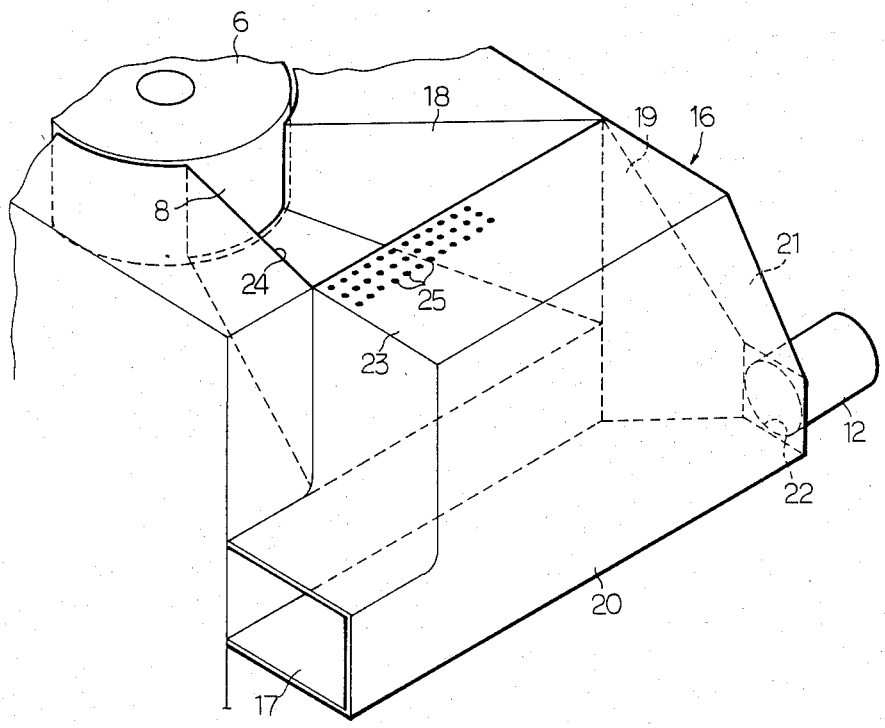
FIG. 5 is a partial perspective view showing the apparatus of FIG. 2 in a larger scale.

As it is seen in FIG. 2 or shown most clearly in perspective view of FIG. 5, the trash removing apparatus according to the preferred embodiment of the invention differs greatly from the conventional apparatus of FIG. 1 in that an additional chamber or a trash transporting chamber 16 is provided to the former apparatus which is directly communicated with an opening 8 formed on part of the inner peripheral wall of a space in which a combing roller 6 of a spinning unit 1 is rotatably disposed. As shown in FIG. 2, the trash transporting chamber 16 is arranged on the front side of the spinning unit 1 in such a way that the trash discharging chamber 9 of FIG. 1 may be extended toward the front and, as shown in FIGS. 4 and 5, then downwards. One end of the trash transporting chamber 16 is formed with an air inlet 17 having a wide opening and positioned, as shown in FIGS. 3 to 5, at a level below the opening 8. The trash transporting chamber 16 includes a side wall 20 which defines the outermost wall thereof and faces opposedly toward the opening 8 through which part of the circumferential surface of the rotating combing roller 6 is exposed, and said chamber 16 is so configured that its side wall 20 may be spaced from the exposed circumferential surface of the combing roller 6 at a distance L, as defined in FIG. 4, which falls within a range from a dimention substantially equal to the diameter D of the combing roller 6 to a measurement substantially equal to two times said diameter D. The forward end of the trash transporting chamber 16 positioned oppositely to said air inlet opening 17 includes an air exit opening 22, and the space adjacent to the air exit 22 of the trash transporting chamber 16 is formed convergent toward said exit 22 by a side wall 19 inclined toward the opposite side wall 20 and a forward wall 21 slanting down in forward direction, both said side wall 19 and forward wall 21 being provided adjacently to said air exit 22 and forming part of the trash transporting chamber 16, as best seen in FIG. 5. The air exit 22 is connected in communication with a trash pipe 12 extending to a trash transporting duct 13.

The side wall 19 adjoins to a wall 18 forming a wall on one side of a trash discharging area, which corresponds to the trash discharging chamber 9 in the apparatus of FIG. 1, and positioned on the side downstream in respect of the movement of the circumferential surface of the combing roller 6 through the opening 8. It is desirable that the side wall 19 should be provided in such a way that an angle $\beta$ made between said side wall 19 and a vertical plane extending in parallel to the axis of a spinning rotor 11 of the spinning unit 1 may be substantially equal to an angle $\alpha$ made between said downstream wall 18 of the trash discharging area and said vertical plane, as shown in the plan view of FIG. 2. As shown in FIGS. 2 and 5, an upper wall 23 forming the top of the trash transporting chamber 16 may be provided with a number of perforations or apertures 25, through which the chamber 16 may be communicated with the atmosphere, in the area thereof adjacent to a wall 24 of the trash discharging area positioned on the upstream side opposite to said downstream wall 18.

The trash removing apparatus of the foregoing construction in an open-end spinning unit operates as follows.

As shown in FIG. 2, rotation of the combing roller 6 causes a flow of accompanying rotary air stream A adjacent to the opening 8 and another flow of centrifugal dispersing air stream B directed away from the opening 8. In addition, vacuum created in the spinning rotor 11 by rotation at a high speed thereof produces a current of suction stream C of air directed toward the opening 8, and the flow of the dispersing air stream B causes a complementary stream U of air in a direction opposite to the flow of said dispersing stream.

Fibers separated by the combing roller 6 are carried forward aided by the rotary stream A of air along part of the annular space formed by and between the combing roller 6 and the inner peripheral wall surface of the space in which the combing roller 6 is rotatably disposed. As the fibers reach the opening 8, relatively heavy impurities 7 contained in the fibers are thrown out thereof toward the trash transporting chamber 16 under the influence of the centrifugal force, while relatively light impurities contained in the fibers, therefore foreign matters offering a very little air resistance, such as short fibers, dust, etc., are entrained on the dispersing stream B of air to move out of the rotary air stream A and then discharged toward the trash transporting chamber 16. Whereas, those long fibers which are light but offer enough air resistance are held by the rotary air stream A and delivered past the opening 8 into the spinning rotor 11 through a fiber feed channel 10.

Because the air inlet 17 of the trash transporting chamber 16 is wide open and a number of perforations 25 are formed in its upper wall 23, the interior of said trash transporting chamber 16 is placed substantially under an atmospheric pressure. Furthermore, because a flow of transporting stream T of air introduced through the air inlet 17 into the trash transporting chamber 16 takes place at a level below the opening 8 and its velocity is sufficiently low due to the atmospheric interior of the chamber 16, the transporting stream T of air will not create a so-called air curtain which would hamper the efficiency in trash removal. Though the suction stream C due to the vacuum in the spinning rotor 11 and the complementary stream U caused by the flow of dispersing stream B of air are both directed toward the opening 8, the air for generating these streams are supplied mainly through the perforations 25 provided in the upper wall 23 of the trash transporting chamber 16, as indicated by a line I in FIG. 4 representing a current of air stream from the exterior of the spinning unit 1. Therefore, these streams of air directed toward the combing roller 6 will not act so as to affect the smooth removal of the impurities which are discharged through the opening 8. The trash 7 thus discharged into the trash transporting chamber 16 are carried into the trash pipe 12 by the flow of transporting stream T of air caused by the blower 14, and transported further to the trash collecting chamber 15 through the transporting duct 13.

The force F at which the trash 7 is discharged through the opening 8 can be formulated as follows: $F=m\cdot D/2\cdot\omega^2$, wherein m represents mass of the trash; D a diameter of the combing roller 6; and $\omega$ a rotational speed of the combing roller 6. Since the combing roller 6 is usually rotated at a constant speed in the range of about 7,000 to 8,000 rpm and the diameter D of the combing roller is also constant, the value for the force F is determined by the variable value for the mass m of the trash 7. Therefore, if the side walls 19, 20 of the trash transporting chamber 16 are so provided that the trash 7 discharged through the opening 8 may be moved and dropped to the flow of the transporting stream T of air without striking such walls 19, 20, the afore-mentioned problem associated with rebounding of the trash 7, thereby being caught by the rotary stream A or suction stream C of air and therefore carried with the fibers into the spinning rotor 11, may be forestalled successfully. That is, in the preferred embodiment of the invention, wherein the side wall 19 of the trash transporting chamber 16 is formed with substantially the same angle as the adjoining forward wall 18 of the trash discharging area adjacent to the opening 8, thereby forming a continuous surface with the latter wall 18, the impurities 7 can be prevented from impinging against the wall 19. Furthermore, because the other side wall 20 of the trash transporting chamber 16 is provided far enough from the opening 8, i.e., it is spaced from the circumferential surface of the combing roller 6 exposed through the opening 8 at a distance L which is within the range from a dimension substantially equal to the diameter D of the combing roller 6 to a dimension substantially corresponding to two times said diameter D, there is very little possibility of the impurities 7 discharged through the opening 8 striking the side wall 20 of the trash transporting chamber 16.

Furthermore, the trash transporting chamber 16 is configured to have a large width, so that the openings of its air exit 22 and the trash pipe 12 connected thereto may have a diameter which is great enough to prevent the blocking of the pipe by deposit of the impurities 7. Unlike the conventional apparatus having the trash discharging chamber 9 (FIG. 1) of substantially closed structure thereby to be placed under vacuum, the trash transporting chamber 16 of the apparatus according to the invention is opened to the atmosphere and, therefore, its interior is maintained at all times substantially under the atmospheric pressure even if deposit of the impurities 7 takes place in the trash pipe 12. Consequently, no change occurs in the atmospheric condition within the trash transporting chamber 16, which means that no variation of trash content in the fibers deposited in the spinning rotor 11 from one spinning unit to another will occur.

To show the advantageous effect obtainable from the apparatus according to the present invention, results of trash contents in fibers deposited in the spinning rotor 11 which are revealed from our experiment conducted under the conditions listed below with the distance L, as defined earlier herein, as the variable are shown in the table provided below.

| | |
|---|---|
| Sliver supplied: | |
| Grain: | 420 gr/6 yd |
| Trash content: | 530 mg/kg |
| Spinning conditions: | |
| Spinning time: | 8 hr |
| Yarn count: | 7'S |
| Twist constant: | 4.8 |
| Spinning rotor speed: | 60,000 rpm |
| Combing roller speed: | 8,000 rpm |

| L | 0.54D | 0.73D | 1.0D | 1.12D | 1.31D | 1.54D | 2.0D |
|---|---|---|---|---|---|---|---|
| Trash content (mg/kg) | 3.4 | 3.2 | 2.2 | 1.6 | 1.1 | 1.0 | 1.0 |

In the above table, L=0.54D represents an arrangement corresponding to the prior art apparatus. As it is apparent from the experimental results shown in the above table, remarkable reduction of trash content in fiber deposit in the spinning rotor, or conspicuous improvement of efficiency in trash removal in an open-end spinning frame, can be accomplished when the value for L ranges from 1.0D to 2.0D.

Though not shown in the table, no remarkable increase in the trash content takes place when the value for L is increased further than the value for 2D. In view of the fact revealed from the experimental findings that the trash content in the trash desposit in the spinning rotor can be effectively reduced in the range where the value for L corresponds to the value for D to 2D, and also of the fact that an increase of the value for L will increase the unit-to-unit distance, thereby calling for more space for installation of the spinning units and that an excessive width of the trash transporting chamber 16 makes it difficult to produce the transporting stream T with a uniform flow of air, it is desirable that the value for L should be set so that it falls within the range from D to 2D.

While the invention has been illustrated and described with reference to a specific embodiment thereof, it may be embodied in other various forms. For example, the perforations 25 through the top wall 23 of the trash transporting chamber 16 may be omitted without influencing the effect of the invention. In such a case, part of the air introduced through the air inlet opening 17 is flown, as indicated by a line II in FIG. 4, toward the upper part of the space in the trash transporting chamber 16 where a slight vacuum is created due to a flow of the dispersing stream B of air, and then joins the complementary stream U and suction stream C. As to the angles $\beta$ of the side wall 19 and $\alpha$ of the forward wall 18, these angles do not have to be necessarily equal to each other.

As it is now apparent from the foregoing description of the embodiments of the invention, in the apparatus for removing trash in an open-end spinning frame according to the invention wherein a trash transporting chamber is provided which is directly communicated with an opening formed on part of the inner peripheral surface of a space in which a combing roller is rotatably disposed, the interior of said trash transporting chamber being placed substantially under the atmosphere and a side wall of said chamber facing the opening opposedly being spaced from the circumferential surface of the combing roller exposed through said opening at a distance in the range from a measurement substantially equal to a diameter of the combing roller to a dimension substantially equal to two times said diameter, the impurities removed from fibers can be discharged through the opening to a flow of transporting stream of air in the trash transporting chamber without impinging against any surrounding wall of the chamber or being caught by a flow of air directed toward the opening, whereby the volume of impurities to be carried with the fibers into the spinning rotor can be greatly reduced, thus improving the efficiency in trash removal. In addition, because there is very little change in atmospheric condition in the trash transporting chamber according to the invention, no variation in trash content in the fiber deposit in the spinning rotor from one spinning unit to another takes place. Therefore, change in the spinning condition with passage of time is reduced so that variation in the spinning condition from one spinning unit to another may be minimized, with the result that yarns with the desired quality can be spun out. The apparatus of the invention is advantageous in terms of maintenance. That is, blocking of the trash pipe with impurities or fibers can be prevented, the serviceable period of time of the spinning rotor before periodical cleaning thereof can be lengthened, and the frequency of yarn breaks can be advantageously reduced, so that the troubles associated with rotor cleaning or yarn piecing operations can be lessened.

What is claimed is:

1. An apparatus for removing trash in a spinning unit of an open-end spinning frame having a combing roller rotatably disposed in a space formed in said spinning unit for separating a sliver into individual fibers, said space being formed with an opening past which part of the circumferential surface of the combing roller may be exposed for discharging impurities contained in the sliver through said opening into a trash discharging area which is directly communicated with said opening, and a spinning rotor rotatable on an axis at a high speed for collecting fibers therein, said apparatus comprising:

a trash transporting chamber disposed in communication with said opening and including a first side wall facing opposedly toward said opening, an air inlet opening on one end thereof, an air exit opening on the other end thereof, a top wall, and a second side wall provided adjacently to said air outlet opening on opposite side to said first side wall;

said trash transporting chamber being so constructed that its interior may be kept substantially under an atmospheric pressure;

said first side wall being spaced from part of the circumferential surface of the combing roller exposed through said opening at a distance whose value falls within a range from a measurement which is substantially equal to a diameter of said combing roller to a measurement which is substantially equal to two times said diameter.

2. An apparatus according to claim 1, wherein said air inlet and exit openings are disposed at a level which is lower than that of said opening.

3. An apparatus according to claim 2, wherein said trash discharging area is formed divergent toward the trash transporting chamber by opposite lateral walls, said second side wall being so provided that an angle made between said second side wall and a vertical plane in parallel to said axis of the spinning rotor may be substantially equal to an angle made between said plane and the lateral wall of said trash discharging area which is formed on the side adjoining to said second side wall.

4. An apparatus according to claim 1, wherein said top wall of the trash transporting chamber has at least one perforation formed therethrough, through which the interior of the trash transporting chamber is communicated with the atmosphere.

* * * * *